US006348103B1

(12) United States Patent
Ahlborn et al.

(10) Patent No.: US 6,348,103 B1
(45) Date of Patent: Feb. 19, 2002

(54) METHOD FOR CLEANING ELECTROFILTERS AND ELECTROFILTERS WITH A CLEANING DEVICE

(75) Inventors: Stefan Ahlborn, Senden; Heiko Schumann, Münster; Harald Blomerius, Bochum, all of (DE)

(73) Assignee: Firma Ing. Walter Hengst GmbH & Co. KG, Münster (DE)

( * ) Notice: Subject to any disclaimer, the term of this patent is extended or adjusted under 35 U.S.C. 154(b) by 0 days.

(21) Appl. No.: 09/462,771

(22) PCT Filed: Apr. 3, 1999

(86) PCT No.: PCT/DE99/01071

§ 371 Date: May 23, 2000

§ 102(e) Date: May 23, 2000

(87) PCT Pub. No.: WO99/59724

PCT Pub. Date: Nov. 25, 1999

(30) Foreign Application Priority Data

May 19, 1998 (DE) ..... 198 22 332

(51) Int. Cl.[7] ..... B08B 7/00; B03B 3/78

(52) U.S. Cl. ..... 134/6; 95/59; 95/74; 95/76; 96/28; 96/40; 96/45; 96/51

(58) Field of Search ..... 134/6, 42; 95/59, 95/74, 75, 76; 96/28, 44, 40, 45, 50, 51; 123/198 E

(56) References Cited

U.S. PATENT DOCUMENTS

| | | | | | |
|---|---|---|---|---|---|
| 2,195,431 | A | * | 4/1940 | Shively et al. | 422/186.04 |
| 2,746,831 | A | * | 5/1956 | Chapman | 445/14 |
| 4,284,420 | A | * | 8/1981 | Borysiak | 96/51 |
| 4,318,718 | A | | 3/1982 | Masatoki et al. | 55/121 |
| 5,183,480 | A | * | 2/1993 | Raterman | 95/74 |
| 5,263,317 | A | | 11/1993 | Shigeo et al. | 60/275 |
| 5,334,238 | A | * | 8/1994 | Goodson et al. | 95/59 |
| 5,626,652 | A | * | 5/1997 | Kohl et al. | 95/45 |
| 5,934,261 | A | * | 8/1999 | Schumann et al. | 123/573 |

FOREIGN PATENT DOCUMENTS

| | | |
|---|---|---|
| EP | 0 433 152 A | 6/1991 |
| JP | 07029668 | 1/1995 |

* cited by examiner

*Primary Examiner*—Frankie L. Stinson
*Assistant Examiner*—Saeed Chaudhry
(74) *Attorney, Agent, or Firm*—Lahive & Cockfield, LLP

(57) ABSTRACT

A method for cleaning a two-stage emission electrode of an electrofilter suitable for use with an internal combustion engine, whereby a cleaning body moves along the emission electrode to strip it of deposits. Only the first stage of the electrode is cleaned by the cleaning body.

15 Claims, 3 Drawing Sheets

METHOD FOR CLEANING ELECTROFILTERS AND ELECTROFILTERS WITH A CLEANING DEVICE

BACKGROUND OF THE INVENTION

The invention relates to a method for cleaning the spray electrode of an electrofilter.

A conventional is shown and described in method EP 0 433 152 A1. In the known method, the filtration performance of the electrofilter is adversely affected to a considerable degree while the spray electrode is being cleaned with a cleaning body. The cleaning body can be passed over almost the entire length of the spray electrode. To eliminate operating problems, it is therefore suggested to operate several electrofilters simultaneously and to clean the spray electrode of only one of the several electrofilters at a time. In this manner, the total filtration performance is adversely affected to a comparatively slight extent by the cleaning. The considerable space requirements and the higher manufacturing costs of such an arrangement of a plurality of electrofilters is taken into account.

A conventional electrofilter is also shown and described in this same publication in which the above-mentioned problems occur. The spray electrode in the form of a wire has a comparatively long length. It is therefore sensitive to vibrations. This adversely affects the choice of possible areas of application. The conventional electrofilter is configured to remove dust from gases.

An object of the invention is to provide an electrofilter that is sturdy, economical to manufacture, and permits a high constant filtration performance and to provide a method that ensures reliable cleaning of the spray electrode without adversely affecting the filtration performance.

SUMMARY OF THE INVENTION

Therefore, according to the invention, instead of the vibration-sensitive wire part, a two-stage design is provided for the spray electrode. A first stage has a comparatively small diameter and a free end. The corona is formed on this first stage, especially at the free end. This first stage can be made comparatively short. The second stage, with a larger diameter and longer by comparison, serves only to maintain the electrical field so that the initially ionized particles can be deposited reliably on the precipitation electrode.

Regular cleaning is required especially in the corona zone of the spray electrode since firmly adhering deposits form there over time even if, theoretically, solids are not to be filtered out aerosols containing oil, such as for example the vent gases from the crankcase in an internal combustion engine are to be filtered.

The two-stage design of the spray electrode makes the latter not only sturdy and insensitive to vibrations but also, because of the different density of the field lines, the solids are deposited almost exclusively on the first stage. Cleaning can therefore be limited to this area with a comparatively short length. Therefore, a correspondingly short-stroke drive for the cleaning body is sufficient that can be accomplished by simple design and economical means.

In addition, the energy to guide the cleaning body on the spray electrode can be provided advantageously exclusively by energy from the engine so that additional driving elements, in the form of an electric drive for example, can be eliminated which are expensive and can be troublesome because of the heat and vibration effects.

For example, an expansion body filled with fluid or gas can be provided connected thermally with the engine and heated by the operation of the engine; the cooling of the engine while it is at rest causes a backwardly directed movement of the expansion body and the cleaning body associated therewith, with the spray electrode being cleaned during this movement.

In addition, pressures or vacuums developed by the engine, in gases or oil for example, can be used to move a membrane that moves the cleaning body into a starting position so that the rearwardly directed movement of the cleaning body takes place during the subsequent shutdown of the engine when the pressure or vacuum is no longer maintained.

This backward movement can be effected by the reduction in the volume of the expansion fluid or by the spring force of the membrane or an additional spring, with the cleaning body being held against the action of the spring during engine operation in a position in which it does not abut the spray electrode so that optimum precipitation performance of the electrofilter is ensured when the engine is running. Alternatively, provision can be made to design the cleaning body and the movable parts connected with it as a spring-mass system so that with certain vibrations of the engine a resonant frequency of this spring-mass system is reached that causes the cleaning body to vibrate so that the body performs its cleaning movement along the first stage of the spray electrode.

Cleaning of the first stage can be made especially simple and functionally reliable if its cross-section remains constant over its length and permits a uniform application of the cleaning body during its movement. For this purpose, this first stage advantageously has a constant cross sectional contour so that a good fit between the cleaning body and the first stage can be ensured. Depending on the selected manufacturing method for the spray electrode, a cross-sectional constant that is not completely identical is reached over the entire length of the first stage. Thus, for example, when casting the electrodes, a certain taper may be necessary to facilitate the removal of the cast electrode body from the casting mode.

In other words, the invention proposes regular cleaning without costly sensory mechanisms or an additional time-measuring device in which the cleaning body is moved along the spray electrode, always at certain operating states of the engine. For example, such a cleaning cycle can be triggered with the engine at rest. Even with relatively long operating times which can occur for example in commercial vehicles such as trucks, buses, or taxis, regular sufficiently frequent cleaning of the spray electrode can be ensured in this manner to guarantee constantly good filtration properties of the electrofilter.

The constantly high filtration performance is achieved with this regular cleaning and can also be supported by the fact that during engine operation the cleaning body is basically not moved along the spray electrode and so the performance of the spray electrode is not adversely affected.

Thus, provision can be made to move the cleaning body by engine power into a starting or resting position only when engine operation begins, in which position it is at a distance from the tip of the spray electrode that forms the corona and from which it starts the cleaning of the spray electrode when the engine is at rest.

However, even if cleaning—as a function of vibration for example—takes place during engine operation, adverse effects of filter performance are comparatively slight since, because of the short length of the first stage of the spray electrode, the distance traveled by the cleaning body is very short and cleaning takes place in a correspondingly short time. It is therefore not necessary to provide additional electrofilters that must be cleaned alternately and to take the associated disadvantages into account.

Embodiments of the invention will be explained in greater detail below with reference to the drawing.

BRIEF DESCRIPTION OF THE DRAWINGS

In FIG. 1, a crankcase ventilation system of an internal combustion engine is shown with the ventilation gases being conducted through an electrofilter 1. Electrofilter 1 has a spray electrode 2 while the housing surrounding spray electrode 2 serves as a precipitation electrode 3.

DESCRIPTION OF ILLUSTRATED EMBODIMENT

Figure 1:
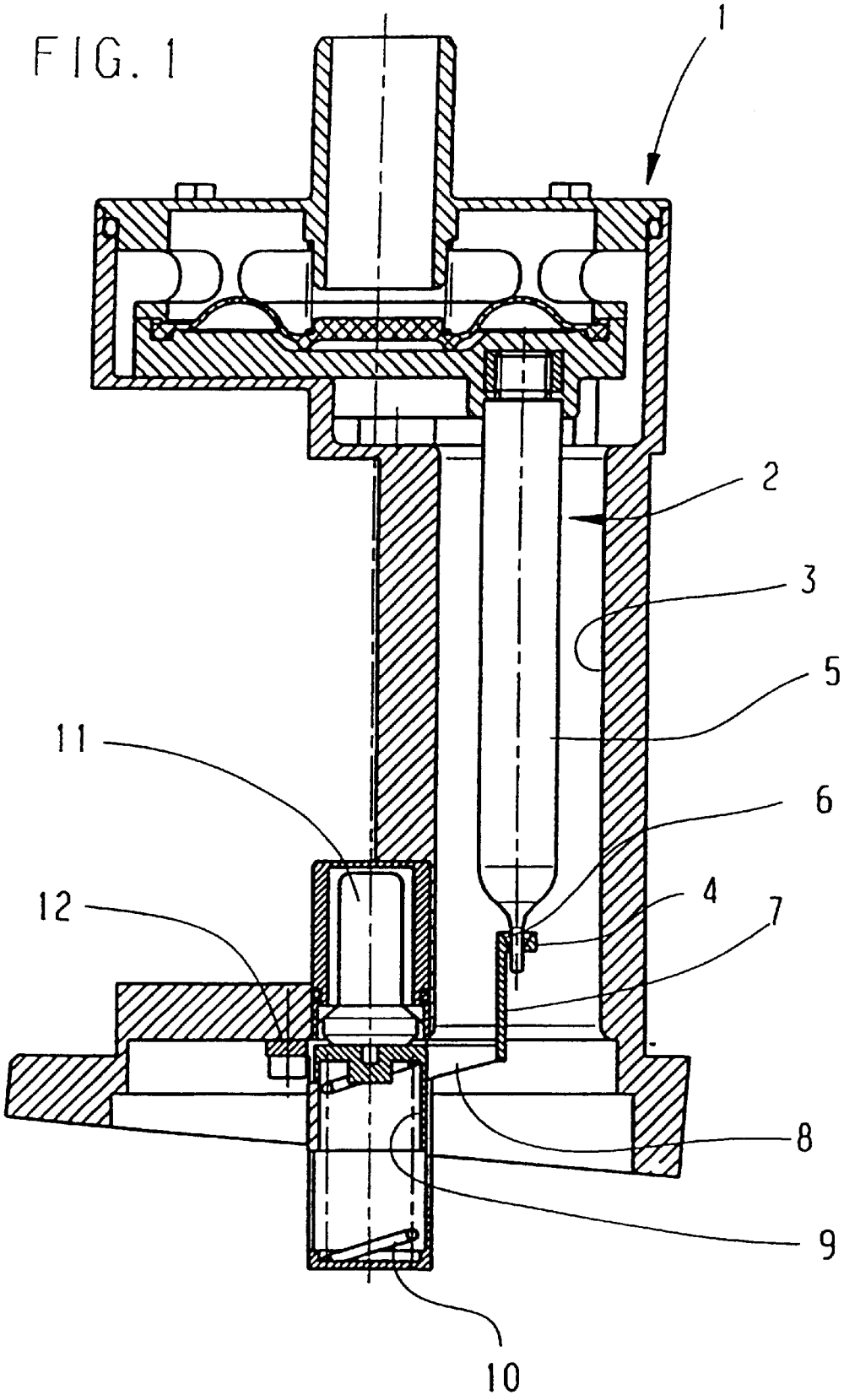
FIG. 1 shows a crankcase ventilation system for an internal combustion engine with a first embodiment of an electrofilter provided with a cleaning device.

Spray electrode 2 is designed in two stages and has a first stage 4 terminating freely, with a nearly constant cylindrical cross section that has a comparatively small diameter and a short axial length. First stage 4 is abutted by a second stage 5 that expands slightly conically over its length, with the entire spray electrode being attached and mounted to the wide end of second stage 5 at the housing.

Because of the small diameter, the electrical field line density is greatest in the area of the first stage. A corona forms there, especially at the free end, serving to ionize the particles to be precipitated. Further along the gas flow, these ionized particles are guided by the electrical field between spray electrode 2 and precipitation electrode 3 and are precipitated on precipitation electrode 3. The field line density produced by second stage 5 is sufficient to maintain the electrical field. The two-stage design of spray electrode 2 produces a very good vibration resistance to the vibrations generated by the internal combustion engine.

First stage 4 is regularly cleaned by a cleaning body 6 that fits around the first stage 4 and is mounted so that it can move along this first stage 4 as a stripper. For this purpose, cleaning body 6 is mounted on an arm 7 which in turn is supported by an extension 8 of a movably mounted sleeve 9. Sleeve 9 is urged upward in the drawing by a compression spring 10, in other words it is held in the position shown in the drawing.

As soon as the engine is started, it acts on an extension body 11 which is connected for example with a coolant circuit of the engine or, as shown in FIG. 1, is heated by the air present in the crankcase and in which the engine heat that is produced causes a liquid or a gas in its interior to expand. Consequently, a plunger 12 of the expansion body 11 moves sleeve 9 and hence extension 8 and arm 7 against the action of compression spring 10 so that cleaning body 6 is removed from the first stage 4 of the spray electrode 2. In this operating position of the engine, the cleaning body 6 is located at a distance from spray electrode 2 so that its function is not adversely affected and optimum precipitation results can be achieved.

With the engine at rest and the engine temperature has fallen, the fluid in extension body 11 contracts. When sleeve 9 is permanently connected with plunger 12, the backward movement of cleaning body 6 can be produced by it. In addition, sleeve 9 is pushed back by compression spring 10 into the position shown in the drawing. Cleaning body 6 is moved to the first stage 4 of spray electrode 2 into the position shown in the drawing and wipes impurities from the first stage 4.

The "threading" of cleaning body 6 on the spray electrode 2 is facilitated by a funnel-shaped guiding surface on cleaning body 6. Especially when, in contrast to the procedure described, cleaning takes place while the engine is running, deviations from optimum alignment of the two parts relative to one another and caused by vibration can be compensated by the funnel-shaped guide surface.

Instead of the temperature-dependent expansion of the fluid in expansion body 11 described above, in a modification of the embodiment, provision can be made for connecting the expansion body to a pressure line of the engine. For example, as a result of oil pressure developed by the engine or by a vacuum, for example by gas removal, a first movement of sleeve 9 can be produced in the manner described and the corresponding rearward movement when the engine is at rest can be effected by a spring comparable to compression spring 10.

Components with the same functions have been given the same reference numerals in the following embodiments as in the embodiment in FIG. 1.

Figure 2:
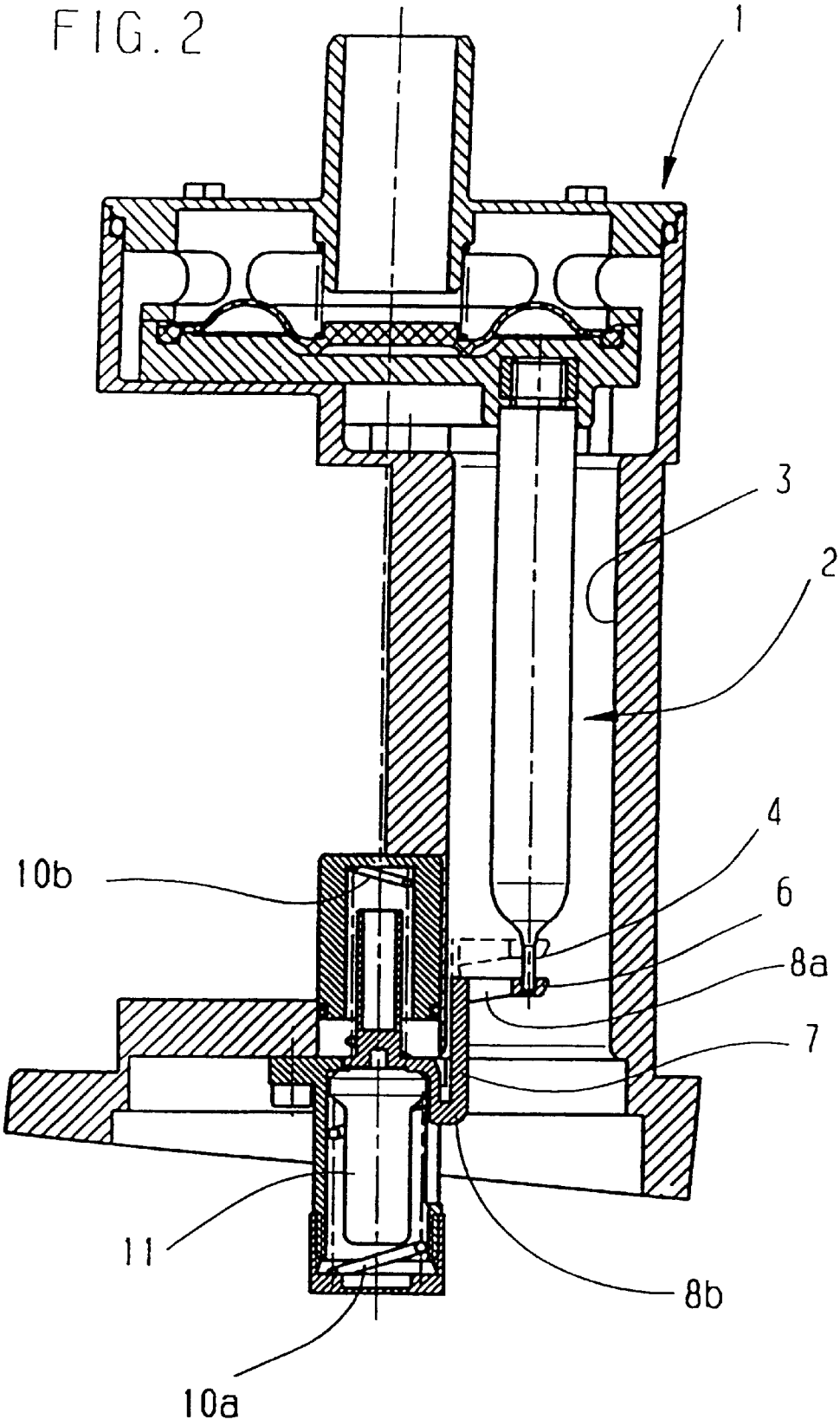
FIG. 2 is a second embodiment with an arrangement of the expanding element that is different from FIG. 1 as well as a different mount for the cleaning body.

FIG. 2 shows a second embodiment of the invention which is theoretically of the same design as the one in FIG. 1. However, arm 7 travels a greater radial distance from the first stage 4 of spray electrode 2. Even when the cleaning body 6 abuts spray electrode 2, the formation of a corona at the free end of first stage 4 is not disturbed in this manner since arm 7 is at a correspondingly long distance. Extension 8 has a first section 8*a* which extends radially outward from cleaning body 6 relative to the first stage 4 and thereby determines the distance of arm 7 from the first stage 4 of spray electrode 2. At the lower end of arm 7, a second section 8*b* of extension 8 is provided to form the connection with expansion body 11.

When the extension body 11 extends during engine operation, the cleaning body 6 is pushed upward along the first stage 4 of spray electrode 2 and therefore moves away from the free end of first stage 4, so that the corona can form nearly undisturbed at this free end and hence the desired cleaning properties of electrofilter 1 are ensured. When the cleaning body 6 is then moved backward as described above, it wipes the impurities from the first stage 4 without coming completely clear of first stage 4 so that the subsequent threading between first stage 4 and cleaning body 6 is avoided and incorrect positioning cannot occur.

In the embodiment according to FIG. 2, expansion body 11 is located closer to the heat-conducting medium inside the engine than in the first embodiment so that more rapid heating and hence a faster expansion of the expansion body 11 is guaranteed. In this manner, assurance is quickly provided that cleaning body 6 is removed from the free tip of first stage 4 and an optimum formation of the corona and hence an optimum cleaning effect of the electrofilter are made possible.

In the embodiment according to FIG. 2, provision is made such that a total of two compression springs 10*a* and 10*b* are used so that the counterbearing for spring 10*a* is subjected to a smaller load since the travel and the forces are distributed between two springs. In addition, the travel times of the cleaning body 6 are shorter so that it is quickly brought into an end position in which the effect of the spray electrode is disturbed as little as possible and the electrofilter has its optimum precipitation effect.

Figure 3:
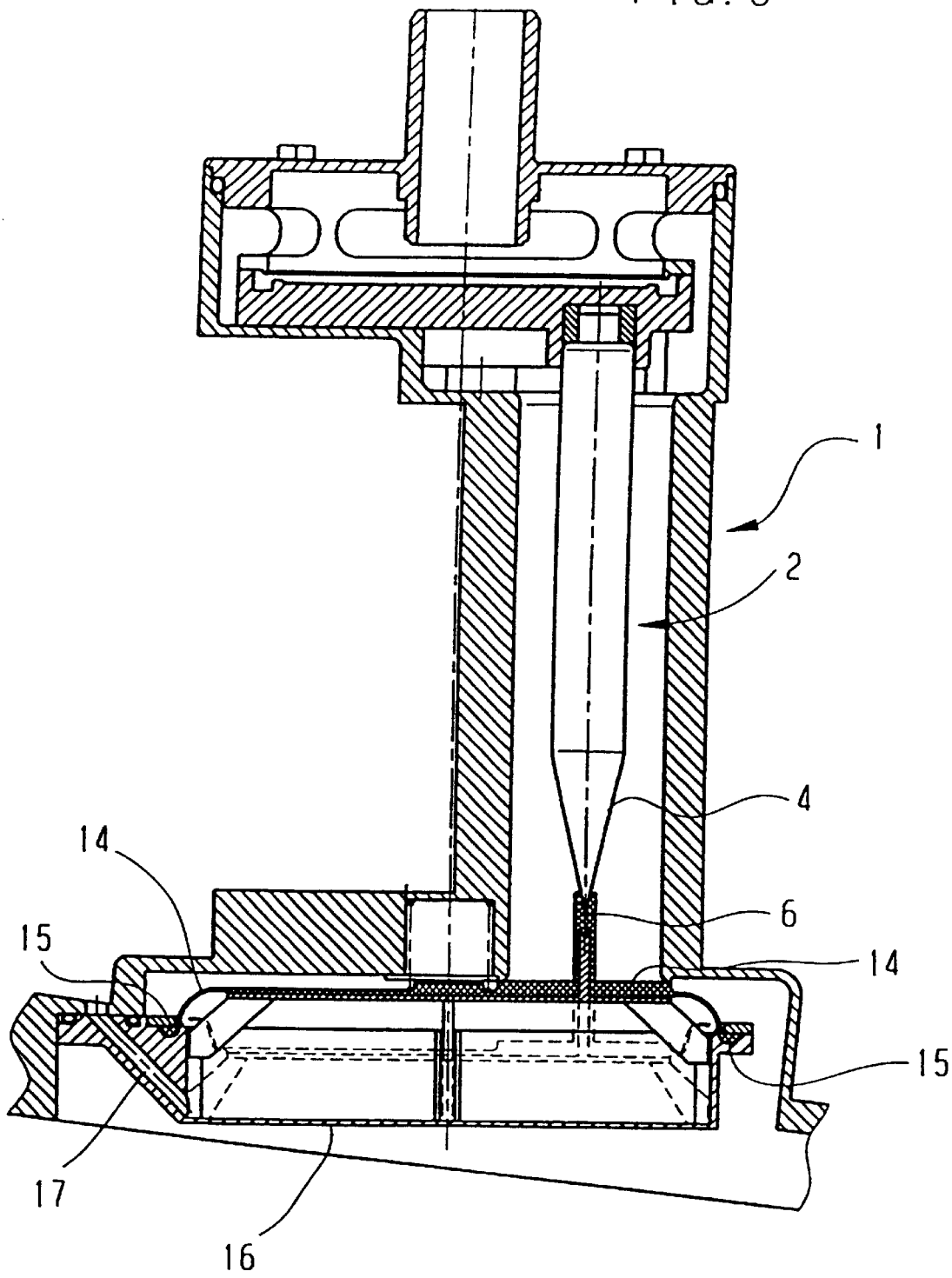
FIG. 3 is a third embodiment with a membrane-actuated cleaning body and with an electrode shape that is different from FIGS. 1 and 2.

In FIG. 3, an embodiment is shown which is not temperature-dependent by contrast with the embodiments in FIGS. 1 and 2 but operates in a pressure-dependent manner. A membrane 14 is secured at its outer circumference 15 and is shown in FIG. 3 by solid lines in a cleaning position in which cleaning body 6 abuts the freely terminating tip of first stage 4 of spray electrode 2. Cleaning body 6 is then in the form of a pin surrounded by an elastomer.

By contrast to the cleaning position, membrane 14, as shown by solid lines, can be moved into a release position in which cleaning body 6 is removed from the free end of first stage 4 and permits the free formation of a corona at this free end.

Membrane 14 is part of a barometric cell 16 that is connected by a bore 17 with the surrounding pressure, for example atmospheric pressure.

Depending on the pressure conditions between the outer ambient pressure which enters the interior of the barometric cell 16 through bore 17 and the pressure prevailing inside the crankcase ventilation system which acts through the interior of electrofilter 1 on membrane 14, the membrane 14 is deformed against its natural elasticity and moves back and forth between the release position and the cleaning position. Depending on the desired cleaning effect, the barometric cell, unlike the embodiment shown in FIG. 3, can be connected to different pressure conditions wherein for example bore 17 is connected with other pressure areas within the entire engine or the cell 16 is not located within the pressure chamber of the crankcase ventilation but in another pressure chamber. Then, however, an additional pressure-regulating membrane would be necessary for the crankcase.

A combination of several of these embodiments is possible, for example with a pressure being applied to one side of a membrane and a vacuum applied to the other side in order to overcome especially high spring forces or to permit especially long travel of the cleaning body.

What is claimed is:

1. Method for cleaning a spray electrode of an electrofilter with a cleaning body, said electrofilter suitable for use with an internal combustion engine, comprising the steps of providing a two-stage spray electrode having a first stage for forming a corona, said first stage terminating in a free end, and wiping only the first stage of the spray electrode with the cleaning body by moving the cleaning body along the first stage, thereby cleaning the spray electrode.

2. Method according to claim 1 further comprising the step of providing engine energy to move the cleaning body along the first stage of the spray electrode.

3. Method according to claim 1 further comprising the step of initiating said wiping of said first stage of said spray electrode when the engine is at rest.

4. Method according to claim 1 further comprising the step of disposing the cleaning body in a resting position by removing the cleaning body from the free end of the first stage of the spray electrode.

5. Method according to claim 1 wherein said spray electrode includes a second stage disposed adjacent said first stage, further comprising the step of disposing the cleaning body in a resting position, wherein the cleaning body abuts the first stage and is disposed close to said second stage when in said resting position.

6. An electrofilter, suitable for use with an internal combustion engine, having a movably mounted cleaning body, comprising a two-stage spray electrode having a first stage terminating in a free end for generating a corona, wherein said first stage has a diameter smaller than the diameter of a second stage and said second stage has a length greater than the length of said first stage, wherein the cleaning body is adapted for movement along said first stage to clean the spray electrode.

7. Electrofilter according to claim 6 further comprising a controller for moving the cleaning body exclusively when the engine is at rest, the cleaning body being movable into a position located at a distance from the first stage of the spray electrode.

8. Electrofilter according to claim 6 wherein said first stage of said spray electrode has a cross sectional contour that is nearly constant over the length of said first stage.

9. Electrofilter according to claim 6 further comprising an expansion body and a spring coupled to said expansion body, said spring acting on the cleaning body and said expansion body being coupled to an engine energy source, wherein said expansion body is adapted to act on the cleaning body when the engine is operating and against a force generated by said spring.

10. Method according to claim 2 wherein said engine energy is one of a vibration, temperature, and pressure differential.

11. Method according to claim 1 further comprising the step of controlling movement of the cleaning body with engine energy.

12. Method according to claim 11 wherein said engine energy is one of a vibration, temperature, and pressure differential.

13. Method according to claim 1 further comprising the step of maintaining the cleaning body in a resting position between cleaning movements, wherein the cleaning body is free of the first stage of the spray electrode when in said resting position.

14. Method according to claim 1 further comprising the step of configuring said first stage of said spray electrode to have a cross sectional contour that is nearly constant over the length of said first stage.

15. Electrofilter according to claim 6, wherein the cleaning body is adapted to move only along said first stage.

* * * * *